US009158262B2

(12) United States Patent
Kawanago et al.

(10) Patent No.: US 9,158,262 B2
(45) Date of Patent: Oct. 13, 2015

(54) IMAGE FORMING APPARATUS

(71) Applicant: Konica Minolta, Inc., Tokyo (JP)

(72) Inventors: Yusuke Kawanago, Tokyo (JP); Takahiro Okubo, Tokyo (JP); Ken Nonaka, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 4 days.

(21) Appl. No.: 14/035,214

(22) Filed: Sep. 24, 2013

(65) Prior Publication Data

US 2014/0086598 A1 Mar. 27, 2014

(30) Foreign Application Priority Data

Sep. 26, 2012 (JP) ..... 2012-212347

(51) Int. Cl.
*B65H 7/10* (2006.01)
*G03G 15/00* (2006.01)

(52) U.S. Cl.
CPC ..... *G03G 15/6561* (2013.01); *G03G 15/6558* (2013.01)

(58) Field of Classification Search
CPC ..... B65H 7/10; B65H 2301/3621; G03G 15/6561
USPC ..... 399/394; 271/228, 249, 252, 277
See application file for complete search history.

(56) References Cited

U.S. PATENT DOCUMENTS 7,880,871 B2 * 2/2011 Kazama et al. ..... 356/139.04
8,783,683 B2 * 7/2014 Izumiya et al. ..... 271/249
2007/0264066 A1 * 11/2007 Peng et al. ..... 399/395
2013/0009358 A1 * 1/2013 Deno ..... 271/227

FOREIGN PATENT DOCUMENTS

JP 09194079 A * 7/1997 ..... B65H 7/10
JP 11-189355 A 7/1999
JP 2000-280554 A 10/2000
JP 2007-022680 A 2/2007
JP 2013-032221 A 2/2013

OTHER PUBLICATIONS

Japanese Notification of Rejection Reasons dated Nov. 25, 2014 .For corresponding JP Patent Application No. 2012-212347 and English translation thereof.

* cited by examiner

*Primary Examiner* — Daniel J Colilla
*Assistant Examiner* — Ruben Parco, Jr.
(74) *Attorney, Agent, or Firm* — Lucas & Mercanti, LLP

(57) ABSTRACT

An image forming apparatus contains a registration correction portion correcting an inclination of the sheet of paper by hitting a forward end of the sheet of paper against a pair of registration rollers, a detection portion that detects an amount of deviation in the sheet of paper, a control portion that calculates a command value of movement for correcting the amount of deviation and a moving portion that moves the registration rollers toward a direction which is perpendicular to a sheet-conveying direction based on the command value of movement with the sheet of paper being nipped with the registration rollers. The control portion controls the moving portion so that the movement of the registration rollers finishes before a limited time of movement or below an upper limit of movement set in relation to the command value of movement.

7 Claims, 9 Drawing Sheets

FIG.8

| TABLE FOR MOVEMENT | BASIC WEIGHTS OF SHEETS OF PAPER UNIT g/m$^2$ | | | | | | | | |
|---|---|---|---|---|---|---|---|---|---|
| | 62~74 | 75~80 | 81~91 | 92~105 | 106~135 | 136~176 | 177~216 | 217~256 | 257~300 |
| TRAY (FOR SINGLE-SIDE PRINTING) | (1) | (2) | (3) | (4) | (5) | (6) | (7) | (8) | (9) |
| ADU (FOR DUPLEX PRINTING) | (1)' | (2)' | (3)' | (4)' | (5)' | (6)' | (7)' | (8)' | (9)' |

IMAGE FORMING APPARATUS

CROSS REFERENCE TO RELATED APPLICATION

The present invention contains subject matter related to Japanese Patent Application No. 2012-212347 filed in the Japanese Patent Office on Sep. 26, 2012, the entire contents of which being incorporated herein by reference.

BACKGROUND OF THE INVENTION

1. Field of the Invention

The present invention relates to an image forming apparatus which is preferably applied to a monochrome printer, a color printer, a copier, a multifunction printer and the like.

2. Description of Related Art

A recent image forming apparatus has been provided with a detection portion for positional displacement and a moving portion having a pair of registration rollers. The detection portion for positional displacement detects a positional displacement of a sheet of paper just before an image-transferring position. The moving portion corrects the positional displacement of the sheet of paper (Deviation Correction) by moving the sheet of paper toward a direction that is perpendicular to a sheet-conveying direction based on a detected amount of positional displacement of the sheet of paper with the sheet of paper being nipped with the pair of registration rollers (see Japanese Patent Application Publication No. 2007-022680).

SUMMARY OF THE INVENTION

In the image forming apparatus with the deviation correction function disclosed in Japanese Patent Application Publication No. 2007-022680, however, the moving portion has any gap such as backlash, which is intentionally provided along the moving direction, in order to move the pair of registration rollers toward the direction that is perpendicular to the sheet-conveying direction. Accordingly, a discrepancy may occur between a command value of an amount of movement (command value of movement) of the pair of registration rollers and an actual measurement thereof based on any frictional force between a conveying path such as paper-passing guide and the sheet of paper and/or a driving load. In this moment, if the command value of movement of the pair of registration rollers is set so as to be larger, a period of the moving time thereof is extended so that the deviation correction may have not yet been completed before the sheet of paper has reached the image-transferring position.

Further, if the same amount of movement is required in a case of thin paper or thick paper on the basis of the basic weight of paper or the like when performing the deviation correction, a period of actual moving time of the pair of registration rollers in the thick paper becomes longer. Consequently, in a case of the thick paper, there may cause a case where the thick paper is moved toward the direction that is perpendicular to the sheet-conveying direction while a forward end of the thick paper is nipped by any transfer rollers at the image-transferring position before the deviation correction has not been completed. This may cause any jam.

Additionally, in an image-forming system provided with the image-forming apparatus having the deviation correction function, if a system speed is increased on the basis of requirement of acceleration, a period of time until the sheet of paper reaches the image-transferring position is shortened. This may cause a case where a sheet of paper is moved toward the direction that is perpendicular to the sheet-conveying direction while a forward end of the sheet of paper is nipped by any transfer rollers at the image-transferring position.

This invention addresses the above-mentioned issues and has an object to provide an improved image forming apparatus in which the deviation correction has been completed surely before the sheet of paper on which registration correction has been performed has reached the image-transferring position and the transfer rollers surely nip each of the sheets of paper on which the deviation correction has been performed even when the sheets of paper have different basis weights.

To achieve the above-mentioned object, an image forming apparatus reflecting one aspect of this invention contains an image forming portion that forms an image on an image carrier, a transferring portion that transfers the image formed on the image carrier to a sheet of paper, a registration correction portion having a pair of registration rollers, the registration correction portion correcting an inclination of the sheet of paper by hitting a forward end of the sheet of paper fed to the transferring portion against the pair of registration rollers, a detection portion that detects an amount of deviation in the sheet of paper, the inclination of which has been corrected, a control portion that calculates a command value of movement for correcting the amount of deviation in the sheet of paper, and a moving portion that moves the pair of registration rollers toward a direction which is perpendicular to a sheet-conveying direction of the sheet of paper based on the command value of movement with the sheet of paper on which registration correction has been performed being nipped with the pair of registration rollers, wherein the control portion controls the moving portion to move the pair of registration rollers below an upper-limit control value set in relation to the command value of movement.

It is desirable to provide the image forming apparatus wherein the upper-limit control value is at least any one of a limited time of movement and an upper limit of movement, the limited time of movement being set in relation to a period of moving time from the time when the pair of registration rollers starts moving to the time when the pair of registration rollers finishes moving, the upper limit of movement being set in relation to the maximum value in a moving permissible range from a position at which the pair of registration rollers starts moving to a position at which the pair of registration rollers finishes moving.

It is also desirable to provide the image forming apparatus wherein the control portion calculates the command value of movement of the pair of registration rollers corresponding to a basic weight of the sheet of paper.

It is still desirable to provide the image forming apparatus wherein the control portion further comprises a storage portion that stores data, the data including a correction coefficient and y-intercept in a linear function graph in which an amount of movement of the pair of registration rollers corresponding to the basic weights of plural sheets of paper corresponds to the command value of movement of the pair of registration rollers.

It is further desirable to provide the image forming apparatus wherein the control portion calculates the command value of movement which corresponds to frictional power occurring between a conveying path for allowing the sheet of paper to be carried to the transferring portion and the sheet of paper.

It is additionally desirable to provide the image forming apparatus wherein when the frictional power occurring between the conveying path and the sheet of paper is increased, the control portion sets the command value of movement so as to be larger.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

BRIEF DESCRIPTION OF THE DRAWINGS

FIG. 8 is a table showing a stored example of a table for movement in ROM 51;

DESCRIPTION OF THE PREFERRED EMBODIMENTS

The following will describe configuration examples of the image forming apparatus as preferred embodiments relating to the invention and control examples thereof, with reference to drawings. It is to be noted that the description in the embodiments is exemplified and any technical scope of the claims and/or meaning of term(s) claimed in the claims are not limited thereto.

Figure 1:
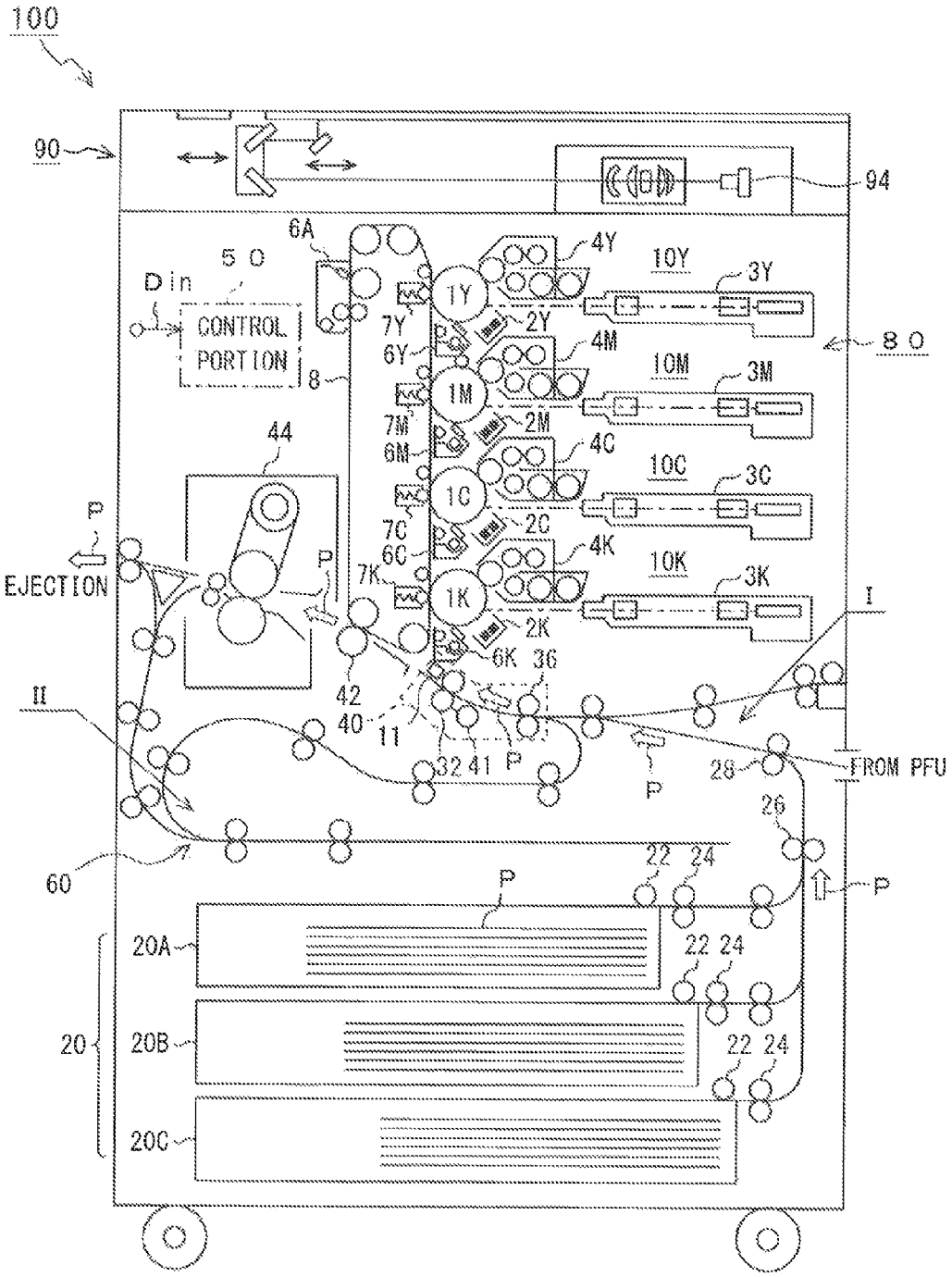
FIG. 1 is a cross sectional view of a color copier 100 according to an embodiment of this invention showing a configuration example thereof.

A color copier 100 shown in FIG. 1 constitutes an example of the image forming apparatus. The color copier 100 has a function of correcting a deviation of a sheet of paper P and forms a color image a predetermined sheet of paper P on which the deviation correction (registration fluctuation correction) has been performed. The image forming apparatus according to this invention is not limited to the color copier 100 but is also applicable to a monochrome printer, a color printer, and a multifunction printer thereof.

The color copier 100 has a deviation correction mode. Here, the deviation correction mode is referred to as an action of moving the sheet of paper P toward a width direction x of the sheet of paper P, which is perpendicular to the sheet-conveying direction y of the sheet of paper P with the sheet of paper P being nipped by the pair of registration rollers just before the image is transferred on the basis of an amount of deviation that is a difference of passed position of an edge of the sheet of paper P in regard to a reference position of the edge of the sheet of paper P (see FIG. 3).

The color copier 100 contains a feeder 20, a registration correction portion 40, a secondary transfer portion 42, a fixing portion 44, a control portion 50, an image forming portion 80 of electrophotographic system, an image reading portion 90 and an automatic document feeding portion. The automatic document feeding portion is not shown and an explanation of a configuration thereof will be omitted for convenience sake.

The image reading portion 90 irradiates light onto the documents or the like conveyed from the automatic document feeding portion 80 one by one and receives reflected light using a charge-couple device (CCD) image sensor 94 to obtain image data. An image processing portion, not shown, performs various kinds of processing such as analog processing, analog/digital (A/D) conversion, compression and the like on the image data of red color (R), green color (G) and blue color (B) (RGB system) obtained by the image reading portion 90.

The control portion 50 receives the image data Din of RGB system from the image processing portion or the like. The control portion 50 converts the image data Din to items of image data, Dy, Dm, Dc and Dk of YMCK system. The image forming portion 80 forms a monochrome image or a color image on the sheet of paper P at the image forming position. For example, the image forming portion 80 forms a color toner image based on the color-converted image data for yellow (Y) color, magenta (M) color, cyan (C) color and black (BK) color.

The image forming portion 80 includes an image forming unit 10Y which forms a yellow (Y) image, an image forming unit 10M which forms a magenta (M) image, an image forming unit 10C which forms a cyan (C) image and an image forming unit 10K which forms a black (K) image. The image forming units 10Y, 10M, 10C and 10K take partial charges of image forming output functions of Y, M, C and BK colors to form the color image on the sheet of paper P having a predetermined size. In this embodiment, in order to indicate a color formed by common function or name, Y, M, C or K will be attached to the number of the common function or name, for example, number 10Y.

The charging portions 2Y, 2M, 2C and 2K respectively corresponding to image colors uniformly charge static charges around surfaces of the photosensitive drums 1Y, 1M, 1C and 1K. Optical writing portions 3Y, 3M, 3C and 3K forms electrostatic latent images on surfaces of the photosensitive drums 1Y, 1M, 1C and 1K based on the image data using polygon mirror system or the like. The developing portions 4Y, 4M, 4C and 4K respectively corresponding to image colors develop the electrostatic latent images. By performing such electrification, exposure and development and driving primary transfer rollers 7Y, 7M, 7C and 7K corresponding to the respective photosensitive drums 1Y, 1M, 1C and 1K for Y, M, C and BK colors, the color toner images formed on the photosensitive drums 1Y, 1M, 1C and 1K are transferred to the intermediate transfer belt 8 (primary transfer). These color toner images are overlaid with each other on the intermediate transfer belt 8.

The secondary transfer portion 42 transfers the overlaid color toner images on the sheet of paper P. The feeder 20 conveys the sheet of paper P from any one of the feeding trays 20A, 20B, 20C and the like to the secondary transfer portion 42. Each of the feeding trays 20A, 20B and 20C contains sheets of paper with a predetermined sheet size. Each of the feeding trays 20A, 20B and 20C is provided with pick-up rollers 22 for feeding the sheet of paper P from each feeding tray and handling rollers 24 for preventing a multiple of sheets of paper from being sent from each feeding tray. In this embodiment, any large capacity paper feeding unit (PFU) that feeds sheets of paper P can be connected to the color copier 100 in addition to the feeder 20.

The registration correction portion 40 is provided on a conveying path of the sheet of paper between the above-mentioned secondary transfer portion 42 and the conveying rollers 28. The registration correction portion 40 includes the pair of registration rollers 32, loop rollers 36 and the moving portion 41. The pair of registration rollers 32 has a configuration as to be movable toward the direction x that is perpendicular to the sheet-conveying direction of the sheet of paper P with the sheet of paper P being nipped by the moving portion 41 shown in FIG. 2. A detection portion 11 for detecting the deviation of the sheet of paper P is positioned at a position which is at an immediately upstream side of the secondary transfer portion 42 and at downstream side of the pair of registration rollers 32. The detection portion 11 detects the amount of deviation that is a difference of passed position of an edge of the sheet of paper P from a reference position Ps of the edge of the sheet of paper P set together with the selection of the size of the sheet of paper fed to the image forming portion 80.

The color copier 100 has a duplex printing mode. The color copier 100 has a sheet inversion unit (ALU) 60. The sheet inversion unit 60 is positioned above the feeding tray 20A and automatically inverts the sheet of paper P, on a surface of which an image has been formed, when performing the duplex printing mode.

The feeder 20 feeds the sheet of paper P from the feeding tray selected on the manipulation/display portion 48 (see FIG. 6) using the pick-up rollers 22 and the like and conveys the fed sheet of paper P to the pair of registration rollers 32 via the conveying rollers 26, 28 and the like. A forward end of the sheet of paper P conveyed to the pair of registration rollers 32 is hit to the pair of registration rollers 32 by the loop rollers 36 so that a skew (inclination) of the sheet of paper P can be corrected (registration correction function).

Figure 2:
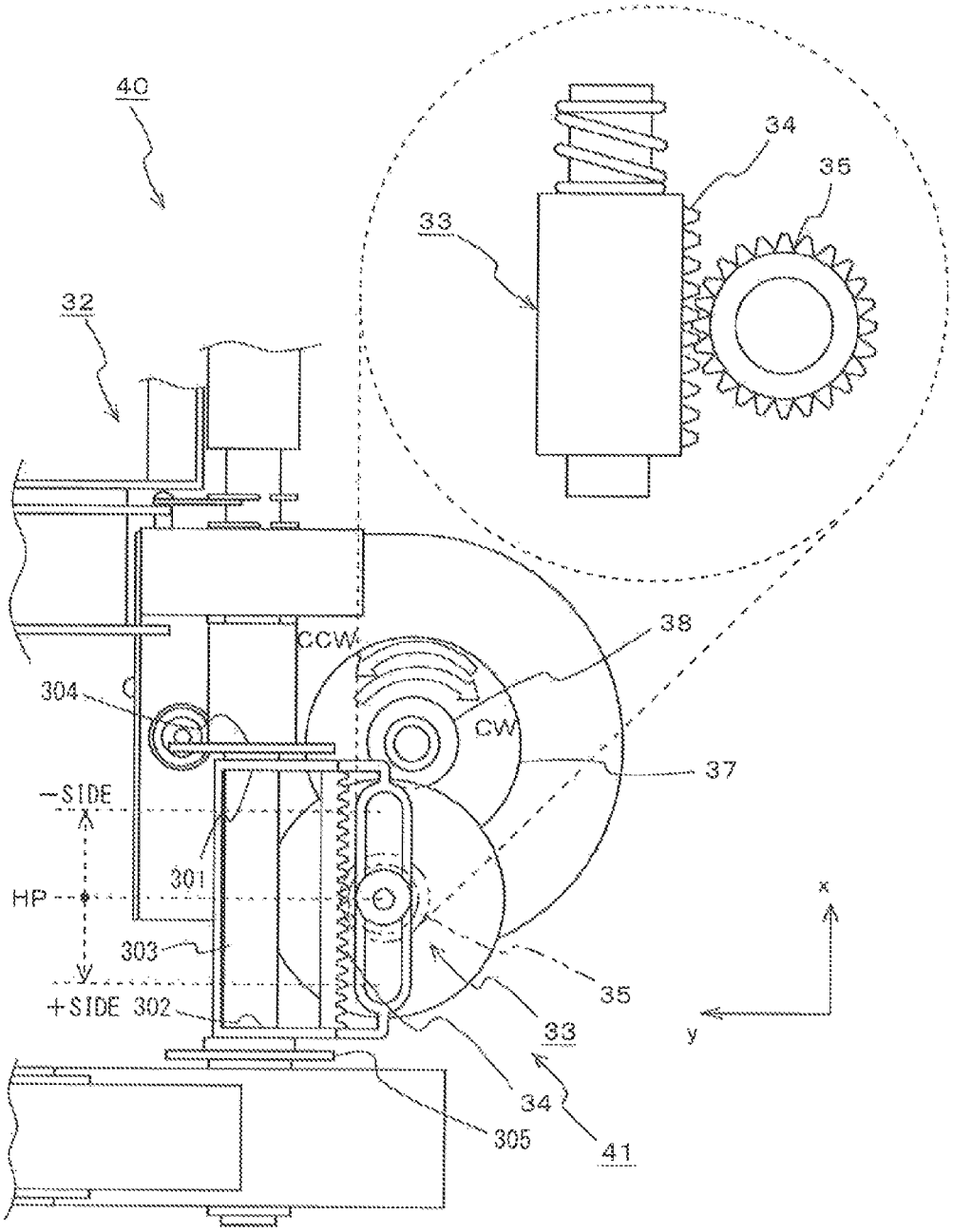
FIG. 2 is a front view of a moving portion 41 showing a configuration example thereof.

When finishing the registration correction function, the moving portion 41 corrects any deviation of the sheet of paper P by moving the pair of registration rollers 32 toward the direction that is perpendicular to the sheet-conveying direction of the sheet of paper P based on the command value of movement with the sheet of paper P, on which the registration correction has been performed, being nipped by the pair of registration rollers 32. The sheet of paper P is then conveyed to the secondary transfer portion 42 at predetermined timing. For example, when a sign "y" shown in FIG. 2 is set as to be the sheet-conveying direction of the sheet of paper P and a sign "x" is set as to be the direction (a width direction of the sheet of paper P) that is perpendicular to the sheet-conveying direction of the sheet of paper P, the moving portion 41 moves the pair of registration rollers 32 toward the direction x that is perpendicular to the sheet-conveying direction y of the sheet of paper P so that an amount of deviation of the sheet of paper P is reduced to zero. The secondary transfer portion 42 transfers the color image supported by the intermediate transfer belt 8 on the sheet of paper P on which the deviation correction has been performed. In this moment, the color toner image is transferred to the sheet of paper P using a nip by the intermediate transfer belt 8 and the secondary transfer portion 42.

The fixing portion 44 fixes the toner image transferred on the predetermined sheet of paper P. The fixing portion 44 contains a pressure roller, a heating roller, not shown. The fixing portion 44 fixes the toner image transferred on the sheet of paper P by applying pressure to the sheet of paper P and/or heating the same. This enables the color image to be formed on the predetermined sheet of paper P based on the image data Din.

Cleaning portions 6Y, 6M, 6C and 6K corresponding to the photosensitive drams 1Y, 1M, 1C and 1K for Y, M, C and K colors are provided below to the left of the photosensitive drums 1Y, 1M, 1C and 1K, respectively. The cleaning portions 6Y, 6M, 6C and 6K remove (clean) the toner materials remained in the photosensitive drums 1Y, 1M, 1C and 1K on which former writing has been performed. A cleaning portion 6A is provided above to the left of the intermediate transfer belt 8 and cleans the toner materials remained in the intermediate transfer belt 8.

When the duplex printing mode is set, the sheet of paper P, on a surface of which the image has been formed, is conveyed from the fixing portion 44 to the sheet inversion unit 60. In the sheet inversion unit 60, the sheet of paper P is automatically inverted. The inverted sheet of paper P is then fed to the image forming portion 80. It is to be noted that a sheet-conveying path from the feeder 20 or the large capacity paper feeding unit to the loop rollers 36 includes a path "I" of the sheet of paper P for single-side printing in FIG. 1 and a sheet-conveying path for the sheet inversion unit 60 includes a path "II" of the sheet of paper P for duplex printing in FIG. 1. Thus, the color copier 100 is configured.

The following will describe a configuration example and an operation example of the moving portion 41 with reference to FIG. 2. The moving portion 41 shown in FIG. 2 has a rack and pinion 33 which is engaged with the pair of registration rollers 32. The rack and pinion 33 is a kind of gears and has a rack portion 34 of toothed bar and a pinion gear 35 having a gear wheel with a small diameter. The rack and pinion 33 converts a rotary power to linear movement.

The rack portion 34 is provided with bearings 301, 302 at their predetermined positions. These bearings 301, 302 connect ends of a rotary shaft 303 of the pair of registration rollers 32 in a rotatable way together with locking mechanisms 304, 305. The rack portion 34 is engaged with the pinion gear 35 and the pinion gear 35 is meshed with a motor gear 38. To the motor gear 38, the motor 37 is fit.

According to this moving portion 41, when driving the motor 37 to apply the rotary power to the pinion gear 35 through the motor gear 38, the rack portion 34 moves to the horizontal direction up to a toothed end thereof. In this moment, the rack portion 34 comes into contact with the locking portion 304 or the like of the pair of registration rollers 32 so that the rotary shaft 303 of the pair of registration rollers 32 moves toward the direction x (width direction of the sheet of paper) which is perpendicular to the sheet-conveying direction y of the sheet of paper P.

This enables the moving portion 41 to move the sheet of paper P, a skew of which has been corrected by hitting the forward end of the sheet of paper P against the nipping portion of the pair of registration rollers 32, toward the direction x which is perpendicular to the sheet-conveying direction y of the sheet of paper P based on a command value of movement in relation to an actual amount of movement $\Delta X$ calculated by the control portion 50 with nipping the sheet of paper P.

On the other hand, there is a variation in a moving amount of the pair of registration rollers 32 based on backlash or the like when the pair of registration rollers 32 moves. Here, the backlash is referred to as a gap intentionally formed along a moving direction between machine components such as the rack portion 34 and the pinion gear 35 used in the moving portion 41, which are engaged with each other to move. Such a gap allows the rack portion 34, the pinion gear 35 and the like to move freely. The symbols, CW and CCW respectively indicate the rotation directions of the motor 37. The symbol CW is a clockwise direction and the symbol CCW is a counter clockwise direction.

The symbol, HP indicates a home position of the pair of registration rollers 32 and a middle portion of the rack portion 34. The symbols, "+ side" and "– side" indicate moving directions of the pair of registration rollers 32 along the direction x which is perpendicular to the sheet-conveying direction y of the sheet of paper P (see FIG. 3). For example, they become indicators when moving the sheet of paper P to the + side or moving the sheet of paper P to the – side. According to the above-mentioned moving portion 41, after the sheet of paper P is delivered to the secondary transfer portion 42, the nipping of the sheet of paper P by the pair of registration rollers 32 is released. The pair of registration rollers 32 then returns to the home position thereof. The secondary transfer portion 42 conveys the sheet of paper P to the fixing portion 44.

Figure 3:
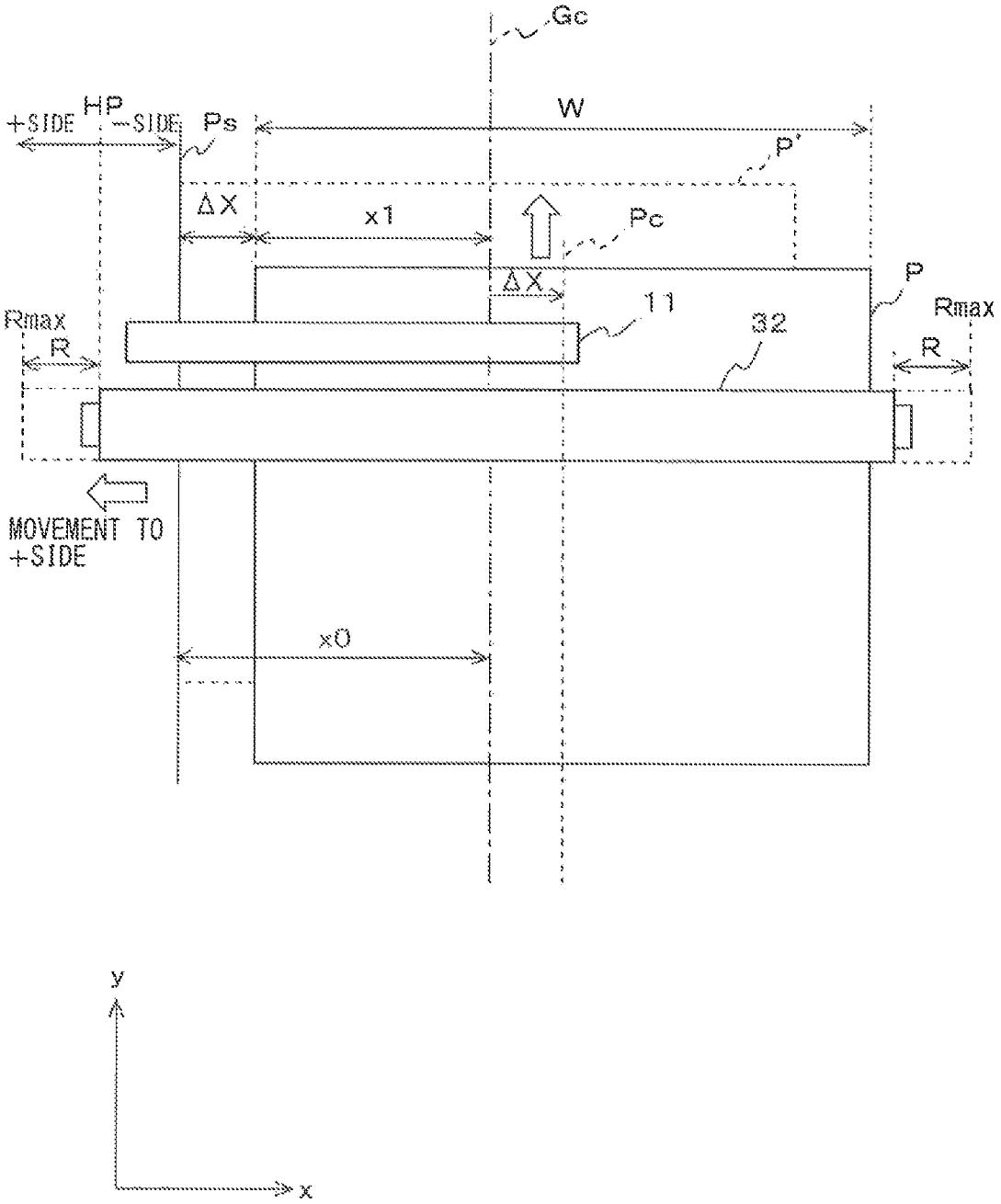
FIG. 3 is a top view illustrating a detection example of a sheet of paper P when correcting the deviation of the sheet of paper P.

The following will describe a detection example of the sheet of paper P when correcting the deviation of the sheet of paper P with reference to FIG. 3. According to the detection example of the sheet of paper P, as shown in FIG. 3, when correcting the deviation of the sheet of paper P, a size W of the sheet of paper P is first fixed so that a reference position Ps of the edge of the sheet of paper P is fixed. This is a case where the sheet of paper P is deviated from the reference position Ps thereof to a right side by an amount of deviation ΔX. This amount of deviation ΔX is an actual amount of deviation of the sheet of paper P.

The detection portion 11 detects the amount of deviation ΔX. A center line of the image (hereinafter, referred to as an "image center Gc") is shown in FIG. 3 by an alternate long and short dash line. In this embodiment, the image formed on the basis of the image center Gc is transferred to the sheet of paper P. A center line of the sheet of paper (hereinafter, referred to as a "sheet center Pc") is shown in FIG. 3 by a dotted line.

Symbol "x0" shown in FIG. 3 is a reference length of the edge of the sheet of paper P and is a length from the image center Gc to the reference position Ps of the edge of the sheet of paper P. Symbol, "x1" shown in FIG. 3 is a passed distance (detected value) of the edge of the sheet of paper P, which is a length from the image center Gc to the passed position of the edge of the sheet of paper P. The amount of deviation ΔX is obtained by calculating a difference between the reference length x0 of the edge of the sheet of paper P and the passed distance x1 of the edge of the sheet of paper P. Actually, it is obtained by converting pixel number in a line sensor constituting the detection portion 11 to any distance information. This amount of deviation ΔX is an actual amount of movement of the sheet of paper P when correcting the deviation of the sheet of paper P. When the sheet of paper P is not deviated to the right side so that the reference position Ps of the edge of the sheet of paper P is coincident with the passed position of the edge thereof, the sheet of paper P is a sheet of paper P' shown in FIG. 3 by the dotted line. Therefore, the sheet of paper P deviated to the right side is moved to a position of the sheet of paper P' shown in FIG. 3 by the dotted line after the deviation of the sheet of paper P has corrected.

In this embodiment, "+ side" and "– side" are set on the basis of the home position HP thereof in the pair of registration rollers 32. The symbols, "+ side" and "– side" indicate moving directions of the pair of registration rollers 32 in relation to the deviation of the sheet of paper P. On a main scanning direction (a direction of rotation axis) of the pair of registration rollers 32, movable regions shown in FIG. 3 by the dotted line are provided on both sides of the pair of registration rollers 32. Here, the main scanning direction is also the direction x which is perpendicular to the sheet-conveying direction y of the sheet of paper P (which is further a moving direction of the pair of registration rollers 32).

A region from an end portion of the pair of registration rollers 32 to an end portion ("R max"=maximum value of the movement) of the movable region is a moving permissible region (hereinafter, also referred to as "moving permissible width R") of the pair of registration rollers 32. In this embodiment, the end portion of the movable region is an end of the rack portion 34. The maximum value in the movement, R max, is the maximum value of the moving permissible width R. The moving permissible widths R are provided on both sides of the pair of registration rollers 32 and their moving amounts are the same when the driving center position thereof meets the image center Gc. In this embodiment, an upper-limit of movement αmax, which is obtained by adding a margin to the maximum value of the movement Pmax, is set as an upper-limit control value in relation to the command value of movement Y.

Figure 4:
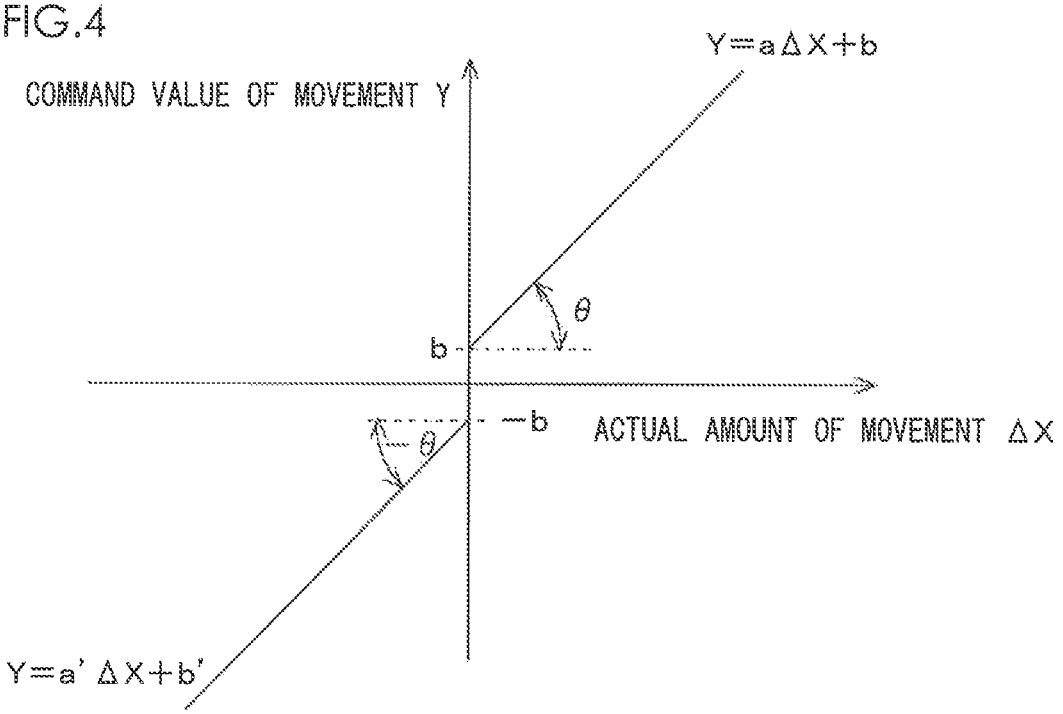
FIG. 4 is a graph showing a relationship example (part one) in a control portion 50 between a command value of movement Y of a pair of registration rollers and an actual amount of movement ΔX thereof.

The following will describe a calculation example of the command value of movement Y in the control portion 50 with reference to FIG. 4. In this embodiment, the control portion 50 calculates the command value of movement Y from the actual amount of movement ΔX. In a graph shown in FIG. 4, a vertical axis indicates the command value of movement Y which is reflected in a moving control signal S4 output from the control portion 50 to the moving portion 41. A horizontal axis indicates the actual amount of movement ΔX output from the detection portion 11 to the control portion 50. The actual amount of movement ΔX is included in the deviation detection signal S11 obtained by the detection portion 11. An inclination of the command value of movement Y is one (θ=45 degrees).

Here, the command value of movement Y is obtained as a linear function on the basis of the following expression (1):

$$Y=a\Delta X+b \tag{1}$$

(in a case of normal rotation of the motor 37, namely, clockwise rotation thereof)

where Y is the command value of movement, ΔX is the actual amount of movement, "a" is a correction coefficient and "b" is y-intercept. However, the actual amount of movement ΔX (amount of deviation ΔX) is a difference between the reference length x0 of the edge of the sheet of paper P and the passing distance x1 of the edge of the sheet of paper P. The correction coefficient "a" (inclination) is fixed on the basis of species of sheet of paper, a sheet-conveying path (either a path for single-side printing or a path for duplex printing) and the like. The y-intercept b is fixed on the basis of a load variation.

The command value of movement Y varies in cases of the normal or reverse rotation of the motor 37. Based on the backlash, the command value of movement Y in the case of the reverse rotation (counter clockwise rotation) is obtained as a linear function on the basis of the following expression (2):

$$Y=a'\Delta X+b' \tag{2}$$

where Y is the command value of movement, ΔX is the actual amount of movement, "a'" is a correction coefficient and "b'" is y-intercept. The control portion 50 controls the moving portion 41 based on the expression (1) or (2) corresponding to the case where the sheet of paper P is deviated to the right side from the reference position Ps of the edge of the sheet of paper P or the case where the sheet of paper P is deviated to the left side from the reference position Ps of the edge of the sheet of paper P.

Figure 5:
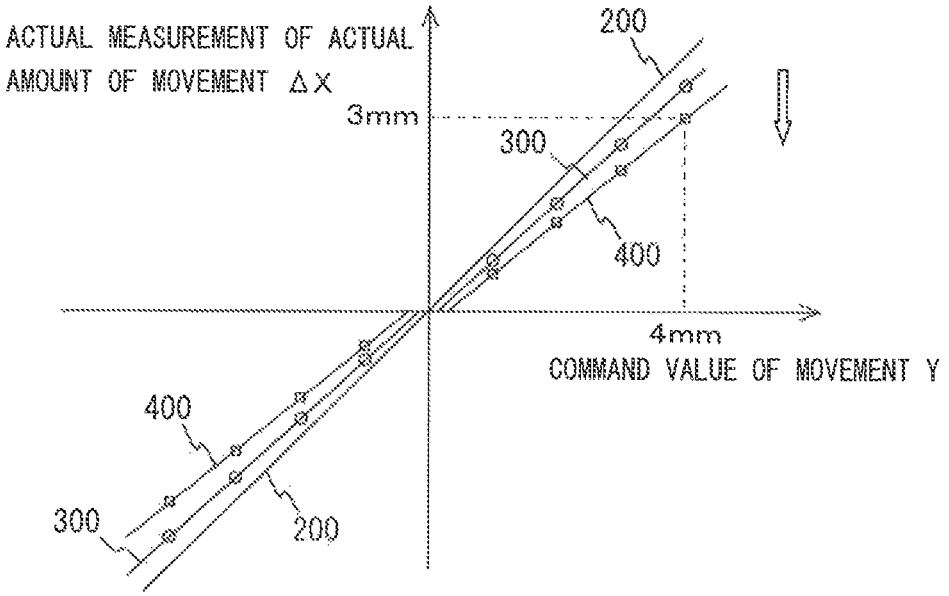
FIG. 5 is a graph showing a relationship example between an actual measurement of actual amount of movement ΔX and the command value of movement Y thereof.

The following will describe a relationship example between an actual measurement of actual amount of movement ΔX and the command value of movement Y thereof. In this embodiment, different correction coefficients (different inclinations) are used on the basis of basic weights of plural sheets of paper P, the path for single-side printing, the path for duplex printing or the like. In FIG. 5, a vertical axis indicates the actual measurement of actual amount of movement ΔX and a horizontal axis indicates the command value of movement Y. Solid line 200 indicates control characteristics of movement (ideal values) in a case where the command value of movement Y is identical to the actual measurement of actual amount of movement ΔX (the inclination of 1; θ45 degrees).

Solid line 300 indicates control characteristics of movement (actual values) in a case of plain paper. Solid line 400 indicates control characteristics of movement (actual values) in a case of thick paper. In a case of plain paper, the actual measurement of actual amount of movement ΔX is 3 mm in relation to the command value of movement Y of 4 mm. There occurs a difference of 1 mm between them. It is conceivable that this difference occurs on the basis of different periods of movement time of the rack portion 34, namely, the pair of registration rollers 32 according to the species of sheet of paper, a sheet-conveying path and the like.

A downward arrow outline with a blank inside, which is shown in FIG. 5, indicates a direction in which the actual amount of movement ΔX is decreased. For example, the actual measurement of actual amount of movement ΔX is 3 mm or less in relation to the command value of movement Y of 4 mm. There occurs a difference of 1 mm or more between them.

Accordingly, in comparison with the control characteristics of movement (ideal values) in a case where the command value of movement Y is identical to the actual measurement of actual amount of movement ΔX (the inclination of 1), the actual measurement is different from the command value of movement Y in the actual values. It is understood that any significant difference occurs in a case of thick paper more than that in a case of plain paper on the basis of basic weights of the sheet of paper P, the path for single-side printing, the path for duplex printing or the like. Therefore, inventors introduce a table for movement (fluctuation), which is used for calculating the command value of movement Y, so that there is no difference between the command value of movement Y and the actual measurement of actual amount of movement ΔX.

Figure 6:
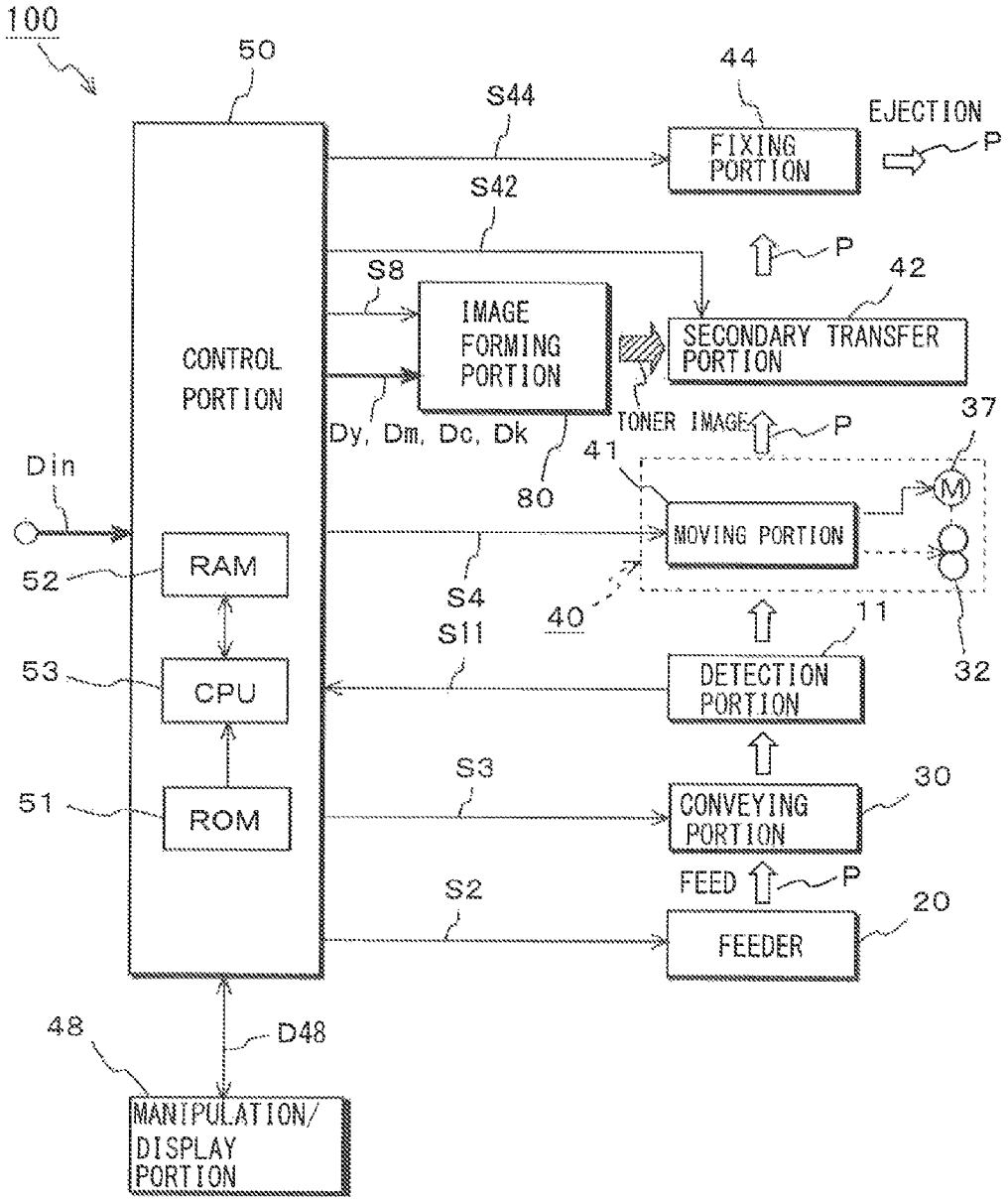
FIG. 6 is a block diagram of the color copier 100 showing a configuration example of a control system thereof.
Figure 7:
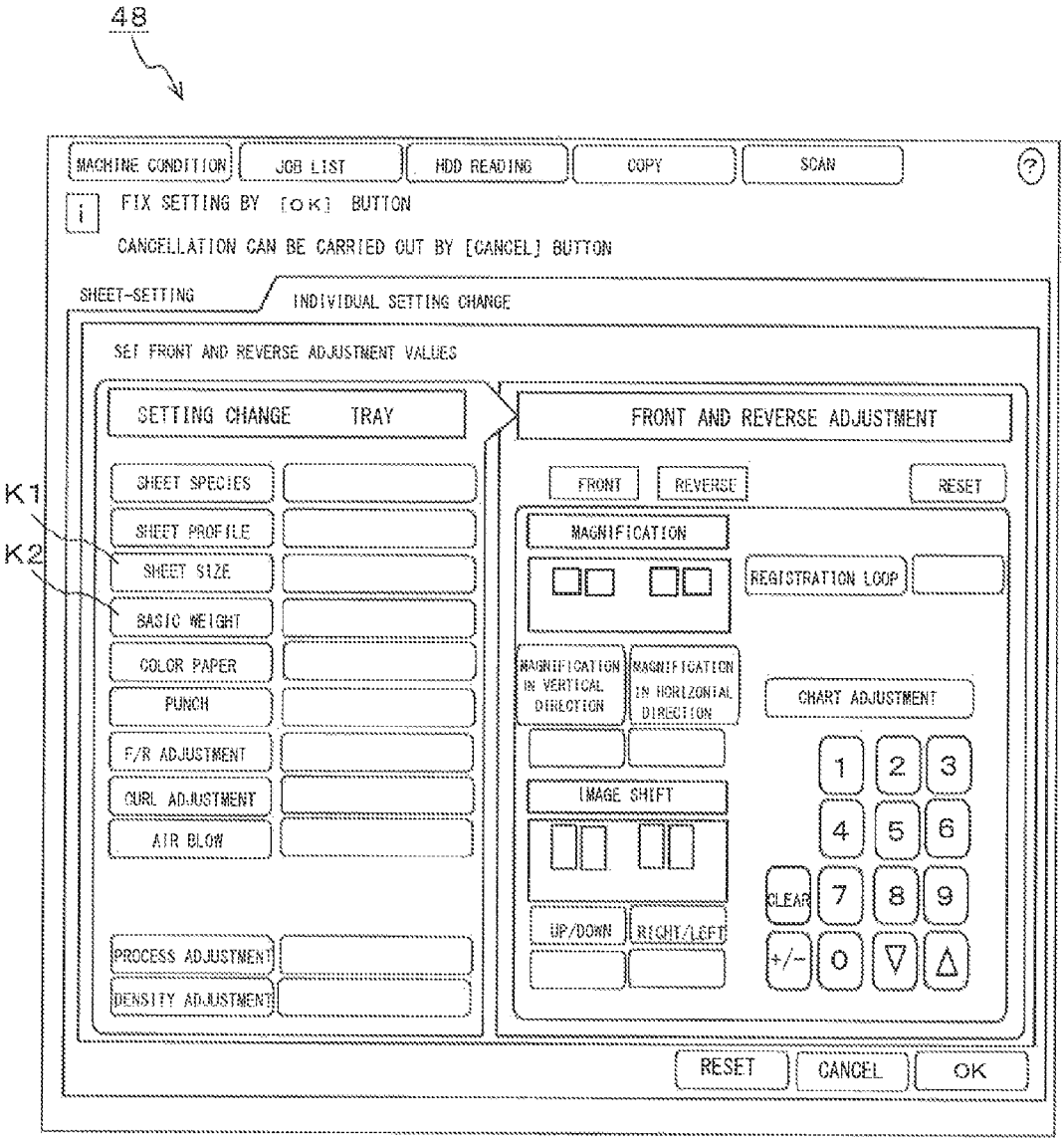
FIG. 7 is a diagram showing an example of user interface (UI) screen displayed on a display and manipulation portion 48.

The following will describe a configuration example of a control system of the color copier 100 with reference to FIGS. 6 through 8. As shown in FIG. 6, the control system of the color copier 100 shown in FIG. 6 contains the detection portion 11, the feeder 20, a conveying portion 30, the registration correction portion 40, the secondary transfer portion 42, the fixing portion 44, a manipuiation/display portion 48, the control portion 50 and the image forming portion 80.

The control portion 50 includes, for example, a read only memory (hereinafter, referred to as "ROM 51") to store control programs or the like, a random access memory (hereinafter, referred to as "RAM 52") to store data temporarily, a central processing unit (hereinafter, referred to as "CPU 53") and the like. The CPU 53 reads the control program out of the ROM 51 at the same time when the power is turned on to extract it on the RAM 52 so that the control system starts up. The CPU 53 controls operations of respective portions in the color copier 100.

The ROM 51 constitutes an example of storage portion. The ROM 51 stores the table for movement, in addition to the control program, in which the actual amount of movement ΔX of the pair of registration rollers 32 corresponding to the basic weights of plural species of the sheets of paper corresponds to the command value of movement of the pair of registration rollers 32 (see FIG. 8). For example, the table for movement is data including a correction coefficient and y-intercept in a linear function graph. By providing the ROM 51 with the table for movement, it is possible to perform any controls such that an amount of movement and/or a period of moving time of the pair of registration rollers 32 can be limited corresponding to the basic weights of the sheets of paper P.

The control portion 50 connects the manipulation/display portion 48. A user manipulates the manipulation/display portion 48 to select an image forming condition when forming the image or to select one feeding tray among the feeding trays 20A, 20B and 20C and the like in each of which sheets of paper P of any predetermined size are contained. The manipulation/display portion 48 outputs any information set therein as the manipulation data D48 to the control portion 50. The manipulation/display portion 48 is composed of a liquid crystal panel, a touch panel, numeric keyboard and the like.

The manipulation/display portion 48 displays a user interface (UI) screen shown in FIG. 7. On the UI screen, setting items such as sheet sizes, basic weights of sheets of paper are displayed. The setting items such as sheet sizes, basic weights of sheets of paper are selected using icon keys K1, K2 and the like. When pressing down the icon key K2 for basic weight of the sheet of paper P, the table for movement shown in FIG. 8 is fixed. In this embodiment, the table for movement is prepared in which the data relating to correction coefficients "a", "a'" and y-intercept "b", "b'" (for building up a linear function graph) is integrated. In the table for movement, the actual amounts of movement ΔX of the pair of registration rollers 32 corresponding to the basic weights of nine species of sheets of paper P correspond to the command values of movement Y of the pair of registration rollers 32.

In the table for movement shown in FIG. 8, basic weights [g/m$^2$] of the sheets of paper P are described in a row and a tray (as a path for single-side printing) and ADU (as a path for duplex printing) are described in a column. The basic weights of sheets of paper P, "62-74", "75-80", "81-91", 92-105", "106-135", "136-176", "177-216", "217-256" and "257-300" are described therein from left to right so that they are put in order from light (thin) paper to heavy (thick) paper. When the basic weight of the sheet of paper P is increased, the frictional power thereof becomes larger.

Regarding the tray (as a path for single-side printing), nine patterns of reference values, (1), (2), (3), (4), (5), (6), (7), (8) and (9) constituting the table for movement are described therein in order from thin paper to thick paper corresponding to the basic weights of the sheets of paper P. Regarding ADU (as a path for duplex printing), nine patterns of reference values, (1)', (2)', (3)', (4)', (5)', (6)', (7)', (8)' and (9)' constituting the table for movement are described therein in order from thin paper to thick paper corresponding to the basic weights of the sheets of paper P. The reference values (9) and (9)' indicate the upper-limit control value of the command value of movement Y in the table for movement.

In the above-mentioned reference values (1) through (9), values of the correction coefficient "a" and y-intercept "b" regarding the command value of movement Y=aΔX+b in a case of normal rotation of the motor 37 and values of the correction coefficient "a'" and y-intercept "b'" in a case of reverse rotation of the motor 37 regarding the command value of movement Y=a'ΔX+b' are described. In the above-mentioned reference values (1)' through (9)', values of the correction coefficient "a" and y-intercept "b" regarding the command value of movement Y=aΔX+b in a case of normal rotation of the motor 37 and values of the correction coefficient "a'" and y-intercept "b'" in a case of reverse rotation of the motor 37 regarding the command value of movement Y=a'ΔX+b' are described. The table for movement describing these reference values (1) through (9) and (1)' through (9)' is stored in the ROM 51 shown in FIG. 6

Referring back to FIG. 6, the control portion 50 connects the feeder 20 and the conveying portion 30. The feeder 20 sends the sheets of paper P out of the feeding tray 20A or the like selected on the basis of a feeding control signal S2 through the pick-up rollers 22, the handling rollers 24 and the like (see FIG. 1). The control portion 50 outputs the feeding control signal S2 to the feeder 20.

The conveying portion 30 conveys the sheets of paper P sent out of the feeder 20 to the secondary transfer portion 42 (image transfer position) of the image forming portion 80 based on a conveying control signal S3. In this embodiment, the conveying portion 30 conveys the sheets of paper P to the pair of registration rollers 32 of the registration correction portion 40 through the conveying rollers 26, the transfer rollers 28 and the like. The registration correction portion 40 correct a skew (inclination) of the sheet of paper P conveyed to the secondary transfer portion 42 by hitting a forward edge of the sheet of paper P to the pair of registration rollers 32 (Registration Correction). The control portion 50 outputs the conveying control signal S3 to the conveying portion 30.

The control portion 50 connects the detection portion 11. The detection portion 11 detects the amount of deviation of the sheet of paper P on which the registration correction has been performed. In this embodiment, the detection portion 11 detects the amount of deviation ΔX from the reference position Ps of an edge of the sheet of paper P which is set together with the selection of the size of the sheet of paper P conveyed to the secondary transfer portion 42 to the passed position of the edge of the sheet of paper P on a conveying path of the sheet of paper P and generates a deviation detection signal S11. The deviation detection signal S11 is a signal indicating the amount of deviation ΔX of the sheet of paper P in relation to the reference position Ps of the edge of the sheet of paper P. The deviation detection portion 11 outputs the deviation detection signal S11 to the control portion 50.

In this embodiment, the control portion 50 obtains the amount of deviation ΔX of the sheet of paper P, on which the registration correction has been performed, from the deviation detection signal S11 and controls the moving portion 41 based on the amount of deviation ΔX. The control portion 50 calculates the command value of movement Y corresponding to the actual amount of movement ΔX of the pair of registration rollers 32 in order to correct the deviation of the sheet of paper P from the amount of deviation ΔX of the sheet of paper P detected by the detection portion 11. In this embodiment, the control portion 50 sets the upper-limit control value so to be at least any one of a limited time of movement and an upper limit of movement of the pair of registration rollers 32 and controls the pair of registration rollers 32 so as to move based on the command value of movement Y in which the upper-limit control value is set. For example, the control portion 50 sets the upper-limit control value so to be at least any one of the limited time of movement and the upper limit of movement of the pair of registration rollers 32. The limited time of movement is set in relation to a period of moving time from the time when the pair of registration rollers 32 starts moving to the time when the pair of registration rollers 32 finishes moving. The upper limit of movement is set in relation to the maximum value in a permissible range from a position at which the pair of registration rollers 32 starts moving to a position at which the pair of registration rollers 32 finishes moving.

In this embodiment, the control portion 50 calculates the command value of movement Y corresponding to frictional power occurring between the conveying path for allowing the sheet of paper P to be conveyed to the secondary transfer portion 42 and the sheet of paper P. It is known that when the basic weight of the sheet of paper is increased, the frictional power is increased while when the basic weight thereof is decreased, the frictional power is decreased. In this embodiment, when the frictional power occurring between the conveying path and the sheet of paper P is increased, the control portion 50 sets the command value of movement Y so as to be larger than that of a case where the frictional power is small.

The moving portion 41 moves the pair of registration rollers 32 toward the direction x that is perpendicular to the sheet-conveying direction based on the command value of movement Y while the sheet of paper P on which the registration correction has been performed is nipped by the pair of registration rollers 32. In this embodiment, the moving portion 41 moves the pair of registration rollers 32 toward the direction x that is perpendicular to the sheet-conveying direction y based on the moving control signal S4 (the command value of movement Y) corresponding to the actual amount of movement ΔX calculated in the control portion 50 while the sheet of paper P, on which the registration correction has been performed, is nipped by the pair of registration rollers 32. This movement enables the deviation of the sheet of paper P to be corrected (Deviation Correction). The moving control signal S4 is a signal for allowing the pair of registration rollers 32 to be moved toward the direction x that is perpendicular to the sheet-conveying direction y of the sheet of paper P. The control portion 50 outputs the moving control signal S4 to the moving portion 41.

The image forming portion 80 forms a color image based on an image forming signal S8 and items of the image data Dy, Dm, Dc and Dk. The image forming signal S8 is a signal for controlling the photosensitive drums 1Y, 1M, 1C and 1K, the charging portions 2Y, 2M, 2C and 2K, the exposing portions 3Y, 3M, 3C and 3K and the developing portions 4Y, 4M, 4C and 4K, which correspond to each image color. The items of image data Dy, Dm, Dc and DK are data for forming the color image. The control portion 50 outputs the image forming signal S8 and the items of image data Dy, Dm, Dc and Dk to the image forming potion 80.

The secondary transfer portion 42 transfers the toner image formed on the intermediate transfer belt 8 on the sheet of paper P based on a transfer control signal S42 (Secondary Transfer). The transfer control signal S42 is a signal for controlling the secondary transfer portion 42. The control portion 50 outputs the transfer control signal S42 to the secondary transfer portion 42. The fixing portion 44 fixes the toner image on the sheet of paper P based on a fixing control signal S44. The fixing control signal S44 is a signal for controlling the fixing portion 44. The control portion 50 outputs the fixing control signal S44 to the fixing portion 44. Thus, the control system of the color copier 100 is configured.

Figure 9:
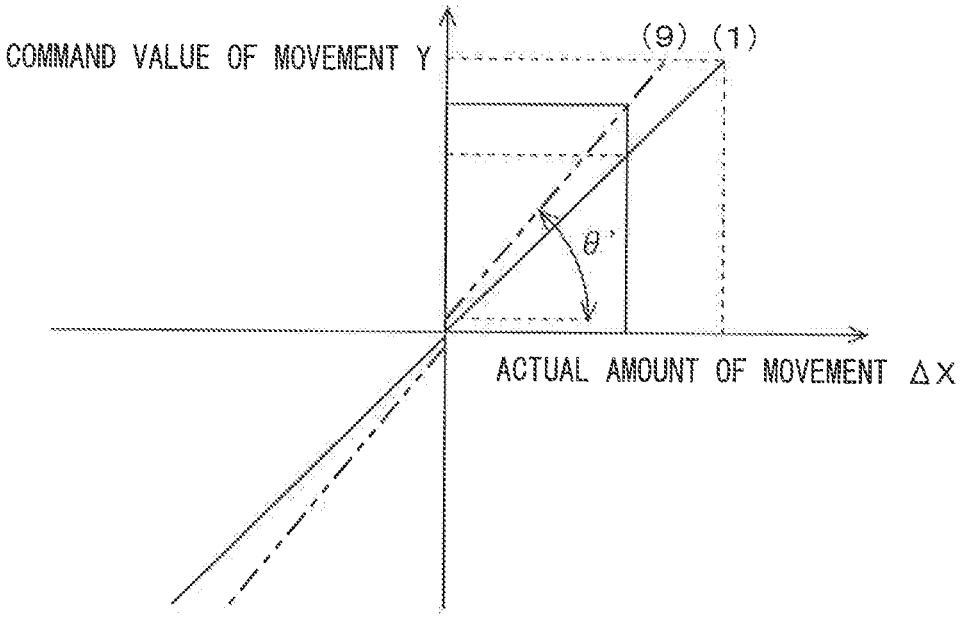
FIG. 9 is a graph showing a relationship example (part two) in the control portion 50 between a command value of movement Y of the pair of registration rollers and an actual amount of movement ΔX.
Figure 10:
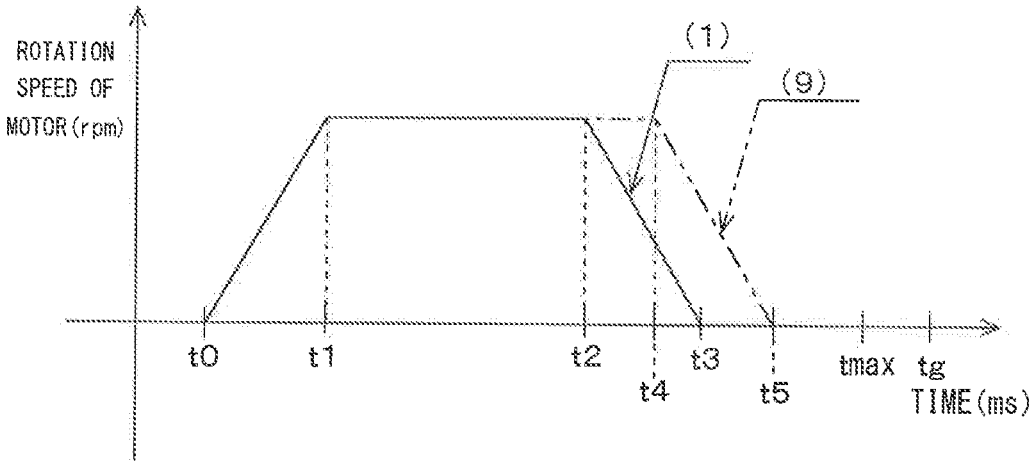
FIG. 10 is a graph showing an operation quality example of a motor 37 when the amount of movement of the pair of registration roller exceeds the upper limit of movement.
Figure 11:
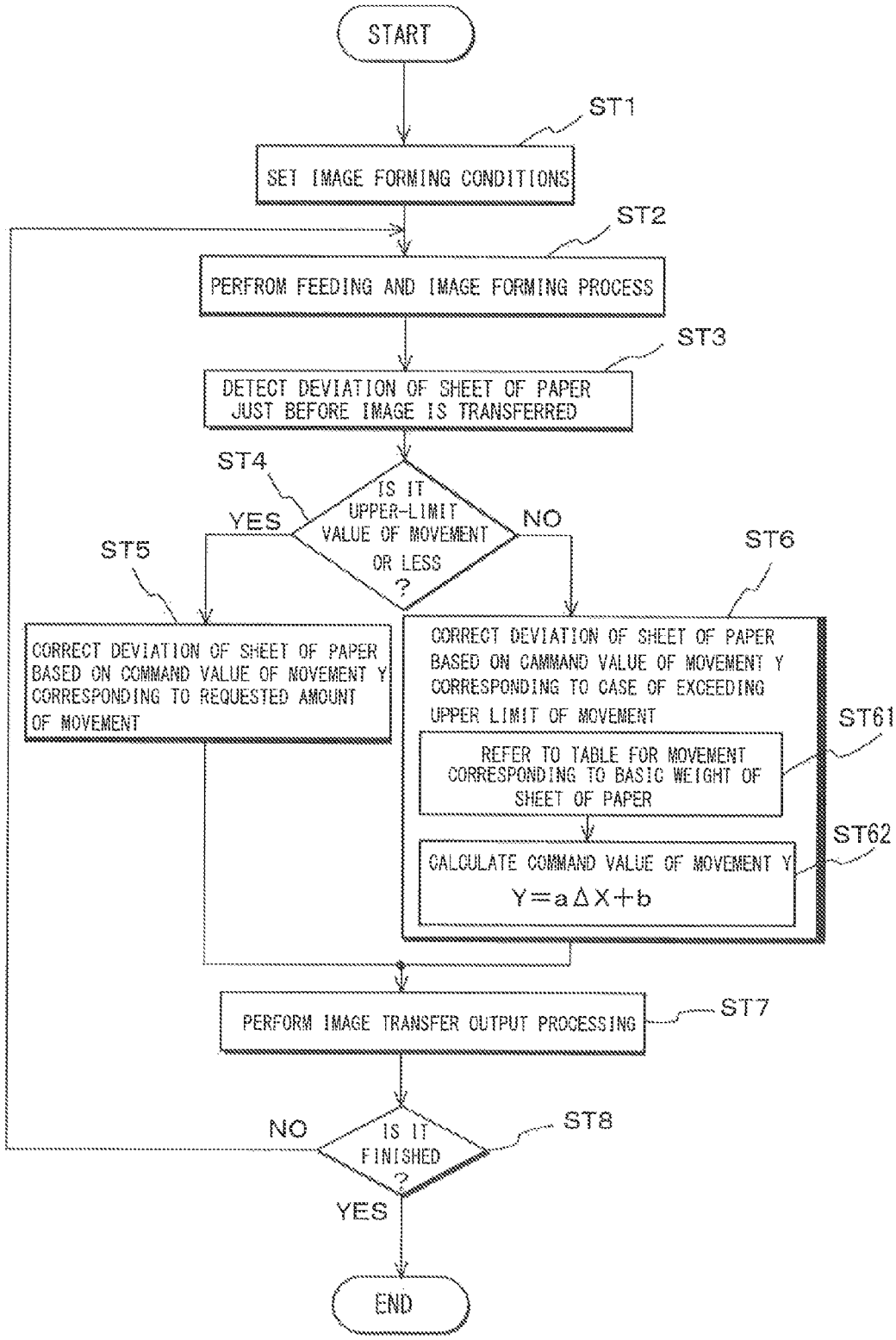
FIG. 11 is a flowchart showing a control example of the image forming apparatus when performing the deviation correction on the sheet of paper P.

The following will describe an operation example of the color copier 100 when correcting the deviation of the sheet of paper P with reference to FIGS. 9 through 11. In this embodiment, the control portion 50 calculates the command value of movement Y of the pair of registration rollers 32 corresponding to the basic weight of the sheet of paper P. For example, a case where the species of sheet of paper P, the basic weight of which is 62 through 74 g/m$^2$ is selected and a case where the species of sheet of paper P, the basic weight of which is 257 through 300 g/m$^2$ is selected are illustrated. Of cause, it is supposed that the sheet of paper P on which the registration correction has been performed is conveyed to the image forming position. The control portion 50 also sets the upper-limit control value in the command value of movement Y for moving the pair of registration rollers 32 to finish the movement of the pair of registration rollers 32 within a period of conveying time from the time when the sheet of paper P on which the registration correction has been performed starts moving to the time when the sheet of paper P reaches the image transferring position. In this embodiment, as the upper-limit control value in the command value of movement Y, the upper limit of movement, αmax+margin is set.

Under these control conditions, as shown in FIG. 11, at a step ST1, the control portion 50 sets image forming conditions. In this moment, a user manipulates the manipulation/display portion 48 to select one feeding tray among the feeding trays 20A, 20B and 20C and the like in each of which sheets of paper P of any predetermined size are contained. The UI screen as shown in FIG. 7 is displayed on the manipulation/display portion 48.

Various kinds of setting items such as sizes of the sheet of paper and the basic weight thereof are displayed on UI screen together with icon keys K1, K2 and the like. When pressing down the icon key K2 relating to the basic weight of the sheet of paper P, the manipulation/display portion 48 outputs operation data D48 for indicating the basic weight of the sheet of paper P to the control portion 50 so that the table for movement corresponding to the basic weight of the sheet of paper P, as shown in FIG. 8, is fixed. In this embodiment, the species of sheet of paper P, the basic weight of which is 62 through 74 g/m$^2$, is selected. In this moment, the reference position Ps of the edge of the sheet of paper P is fixed together with the selection of the size of the sheet of paper P.

Next, at a step ST2, the control portion 50 performs the feeding and image forming process. The control portion 50 controls the feeder 20 to feed the sheet of paper P, the basic weight of which is 62 through 74 g/m$^2$, from the feeding tray selected among the feeding trays 20A, 20B and 20C and the like to the image forming portion 80. In the image forming portion 80, the optical writing portions 3Y, 3M, 3C and 3K form the electrostatic latent images on the photosensitive drums 1Y, 1M, 1C and 1K uniformly charged by the charging portions 2Y, 2M, 2C and 2K based on the image forming signal S8 and the items of image data Dy, Dm, Dc and Dk. The developing portions 4Y, 4M, 4C and 4K respectively corresponding to image colors develop the electrostatic latent images. The developed toner images are primarily transferred to the intermediate transfer belt 8 from the photosensitive drums 1Y, 1M, 1C and 1K.

At a step ST3, the control portion 50 controls the detection portion 11 to detect the deviation of the sheet of paper P just before the sheet of paper reaches the secondary transfer portion 42. The detection portion 11 detects the amount of deviation ΔX of the sheet of paper P from the reference position Ps of the edge of the sheet of paper P, which is set together with the selection of the size of the sheet of paper, to the passed position of the edge of the sheet of paper P. The detection portion 11 then outputs the deviation detection signal S11 to the control portion 50.

At a step ST4, the control portion 50 determines whether or not the amount of deviation ΔX of the sheet of paper P is the upper-limit of movement, αmax or less. In this moment, the control portion 50 sets the upper-limit control value in the command value of movement Y of the pair of registration rollers 32. The upper-limit control value in the command value of movement Y is the upper-limit of movement αmax of + or − side based on the home position HP of the pair of registration rollers 32. By comparing the amount of deviation ΔX with the upper-limit of movement αmax, the control branches into a case of ΔX≤αmax and a case of ΔX>αmax.

In this embodiment, at the step ST1, the sheet of paper P, the basic weight of which is 62 through 74 g/m$^2$, has been selected and if the amount of deviation ΔX of the sheet of paper P is the upper-limit of movement, αmax or less, the control goes to a step ST5 where the deviation correction is performed on the basis of the command value of movement Y corresponding to the actual amount of movement ΔX. In this moment, the control portion 50 receives the deviation detection signal S11 from the detection portion 11 and calculates the command value of movement Y corresponding to the actual amount of movement ΔX from the amount of deviation ΔX to correct the deviation of the sheet of paper P.

In this case, reference value (1) in the table for movement is referred in connection with the command value of movement Y. This is a case where the inclination "a" is one in the command value of movement Y (=aΔX+b) based on the table for movement as to the reference value (1) shown in FIG. 9 by solid line. By the reference of this table for movement, the command value of movement Y is identical to the actual amount of movement ΔX so that the period of operation time of the motor 37 is set to be the same value in the command value of movement Y and the actual amount of movement ΔX.

In FIG. 10 showing an operation (driving) quality example of the motor 37 based on the table for movement as to the reference value (1), a vertical axis indicates a rotation speed (rpm) of the motor 37 and a horizontal axis indicates a period of operation time (ms) of the motor 37. In this embodiment, the operation quality of the motor 37 shown by solid line shows a trapezoid in which acceleration, fixed speed and deceleration of the motor 37 are based on the reference value (1) in the table for movement as to the command value of movement Y.

The control portion 50 controls the moving portion 41 to move the pair of registration rollers 32 toward the direction x which is perpendicular to the sheet-conveying direction y based on the command value of movement Y corresponding to the calculated actual amount of movement ΔX with the sheet of paper on which the registration correction has been performed being nipped by the pair of registration rollers 32. In this moment, according to the operation quality of the motor 37, the motor 37 starts up at a point of time t0 and the motor 37 accelerates during a period of time from the point of time t0 to a point of time t1. The motor 37 then keeps a fixed speed up to a point of time t2. The motor 37 decelerates during a period of time from the point of time t2 to a point of time t3. The motor 37 then stops at the point of time t3. The conveying portion 30 conveys the sheet of paper P to the secondary transfer portion 42.

At a step ST7, the control portion 50 controls the secondary transfer portion 42 to perform image transfer output processing. The secondary transfer portion 42 transfers the toner image on the intermediate transfer belt 8 to the sheet of paper P based on the transfer control signal S42 (Secondary Transfer). The sheet of paper P, on which the secondary transfer has been performed, is fixed by the fixing portion 44 and is then ejected out of the image forming apparatus. It is to be noted that in the moving portion 41, the nip of the sheet of paper P by the pair of registration rollers 32 is released after the sheet of paper P is conveyed to the secondary transfer portion 42. The pair of registration rollers 32 is return to the home position HP thereof and is ready for the deviation correction of next sheet of paper P.

If the amount of deviation ΔX of the sheet of paper P exceeds the upper-limit of movement, αmax at the step ST4, the control goes to a step ST6 where the control portion 50 performs the deviation correction based on the command value of movement Y corresponding to a case of exceeding the upper-limit of movement because the sheet of paper P, the basic weight of which is 257 through 300 g/m$^2$, has been selected at the step ST1. The control portion 50 controls the moving portion 41 to finish the movement of the pair of registration rollers 32 below the upper-limit control value set in relation to the command value of movement Y.

For example, at a step ST61, the control portion 50 refers to the table for movement corresponding to the basic weights of the sheets of paper. In this embodiment, the sheet of paper P, the basic weight of which is 257 through 300 g/m$^2$, has been selected and the inclination "a" of the command value of movement Y (=aΔX+b) is one or more (θ'>45 degrees) in FIG. 9. Reference value (9) in the table for movement is referred in connection with the command value of movement Y so that a linear function graph shown in FIG. 9 by a dashed line is formed.

At a step ST62, the control portion 50 calculates the command value of movement Y corresponding to the basic weight of the sheet of paper P. In the calculation, since the command value of movement Y is different from the actual amount of movement ΔX, the operation time of the motor 37 is set so as to be different in cases of the command value of movement Y and the actual amount of movement ΔX. The operation quality example of the motor 37 shown in FIG. 10 by the dashed line shows a trapezoid in which acceleration, fixed speed and deceleration of the motor 37 are based on the reference value (9) in the table for movement as to the command value of movement Y. This trapezoid has a longer fixed speed portion than that of the trapezoid based on the reference value (1) so that it is seen long from side to side. Thus, the operation time of the motor 37 is extended.

In this embodiment, according to the operation quality of the motor 37 shown in FIG. 10 by the dashed line, the motor 37 starts up at the point of time t0 and the motor 37 accelerates during the period of time from the point of time t0 to the point of time t1. The motor 37 then keeps a fixed speed up to a point of time t4, at which the operation time of the motor 37 is extended as compared with a case where the sheet of paper P, the basic weight of which is 62 through 74 g/m$^2$, is selected. The motor 37 decelerates during a period of time from the point of time t4 to a point of time t5. The motor then stops at the point of time t5.

Further, time, tmax is a limited time of movement and is an upper-limit control value in a period of moving time of the pair of registration rollers 32. This limited time of movement, tmax is set within a period of conveying time up to a point of time tg when the sheet of paper P, on which the registration correction has been performed, reaches the secondary transfer portion 42 after the sheet of paper P starts being carried to the secondary transfer portion 42 at a starting time of an image forming signal Vtop, not shown. Further, the limited time of movement, tmax is a maximum value of the time required which is permissible within the period of conveying time. In this embodiment, since the limited time of movement, tmax is set within the period of conveying time of the sheet of paper P, it is possible to finish the movement of the pair of registration rollers 32 before the limited time of movement, tmax.

At the step ST7, the control portion 50 controls the secondary transfer portion 42 to perform image transfer output processing (the above-mentioned secondary transfer). In the moving portion 41, the nip of the sheet of paper P by the pair of registration rollers 32 is released after the sheet of paper P is conveyed to the secondary transfer portion 42. The pair of registration rollers 32 is return to the home position HP thereof and is ready for the deviation correction of next sheet of paper P.

at a step ST8, the control portion 50 determines whether or not the image forming control finishes by detecting an end of flag (EOP) or the like. If EOP is detected, the image forming control finishes. If EOP is not detected, the control goes back to the step ST2 where the above-mentioned control is repeated.

Thus, in the color copier 100 according to the embodiment of the invention, when moving the pair of registration rollers 32 toward the direction x which is perpendicular to the sheet-conveying direction y based on the command value of movement Y corresponding to the actual amount of movement ΔX with the sheet of paper on which the registration correction has been performed being nipped by the pair of registration rollers 32, the control portion 50 controls the moving portion 41 to finish the movement of the pair of registration rollers 32 below the upper-limit control value set in relation to the command value of movement Y.

Such a control enables the deviation correction to be completed surely before the forward end of the sheet of paper P, on which the registration correction has been performed, reaches the image transfer position. This allows the color copier 100 to nip each of the sheets of paper P, on which the deviation correction has been performed, by the secondary transfer rollers surely even when the sheets of paper P have different basic weights. Accordingly, the color copier 100 can avoid transferring the toner image to the sheet of paper P on the way to the deviation correction. The color copier 100 prevents any jam from occurring and is able to form a high quality image regardless of the basic weight of the sheet of paper P. Further, the color copier 100 can accelerate the image forming system having the deviation correction function.

According to the color copier 100, the moving portion 41 is controlled so that the movement of the pair of registration rollers 32 finishes below an upper-limit control value which is at least any one of the limited time of movement, tmax and the upper limit of movement, Δmax. Accordingly, the color copier 100 can transfer the toner image to the sheet of paper P, the deviation correction of which has been completed surely before the sheet of paper P has reached the secondary transfer portion 42.

According to the color copier 100, the moving portion 41 is controlled so that the movement of the pair of registration rollers 32 finishes below an upper-limit control value of the calculated command value of movement Y corresponding to the basic weight of the sheet of paper P. Accordingly, the color copier 100 can transfer the toner image to the sheet of paper P, the deviation correction of which has been completed surely before the sheet of paper P has reached the secondary transfer portion 42.

According to the color copier 100, the moving portion 41 is controlled so that the movement of the pair of registration rollers 32 finishes below an upper-limit control value of the calculated command value of movement Y corresponding to the frictional power occurring between a conveying path for allowing the sheet of paper to be conveyed to the secondary transfer portion and the sheet of paper. For example, the moving portion 41 is controlled so that the movement of the pair of registration rollers 32 finishes below an upper-limit control value of the command value of movement Y set to be larger than that of the case where the frictional power is small when the frictional power occurring between the conveying path and the sheet of paper is increased. Accordingly, even when a sheet of paper having larger basic weight is selected so that the frictional power is increased, it is possible to finish the deviation correction within the period of conveying time from a point of time when the sheet of paper P, on which the registration correction has been performed, starts being conveyed to a point of time when the sheet of paper P reaches the image transferring position.

According to the color copier 100, since the table for movement corresponding to basic weights of plural sheets of paper P is provided, in which the actual amount of movement ΔX of the pair of registration rollers 32 corresponds to the command value of movement Y thereof, the moving portion 41 is controlled so that the movement of the pair of registration rollers 32 can finish below an upper-limit control value set in the command value of movement Y by referring to the table for movement.

Although the cases where the sheets of paper P, the basic weights of which are 62 through 74 g/m$^2$ and 257 through 300 g/m$^2$, have been selected have been described in the embodiments, this invention is not limited thereto: Regarding the cases where the sheets of paper P, the basic weights of which are 75 through 80 g/m$^2$, 81 through 91 g/m$^2$, 92 through 105 g/m$^2$, 106 through 135 g/m$^2$, 136 through 176 g/m$^2$, 177 through 216 g/m$^2$ and 217 through 256 g/m$^2$, are selected, similar effect can be obtained by applying the corresponding reference values (2) through (8) in the table for movement thereto.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus comprising:

an image forming portion that forms an image on an image carrier;

a transferring portion that transfers the image formed on the image carrier to a sheet of paper;

a registration correction portion having a pair of registration rollers, the registration correction portion correcting an inclination of the sheet of paper by hitting a forward end of the sheet of paper fed to the transferring portion against the pair of registration rollers;

a detection portion that detects an amount of deviation in the sheet of paper, the inclination of which has been corrected;

a control portion that calculates a command value of movement for correcting the amount of deviation in the sheet of paper; and a moving portion that moves the pair of registration rollers toward a direction which is perpendicular to a sheet-conveying direction of the sheet of paper based on the command value of movement with the sheet of paper on which registration correction has been performed being nipped with the pair of registration rollers, wherein the control portion controls the moving portion to move the pair of registration rollers below an upper-limit control value set in relation to the command value of movement;

wherein the control portion further comprises a storage portion that stores data, the data including a correction coefficient and y-intercept in a linear function graph in which an amount of movement of the pair of registration rollers corresponding to the basic weights of plural sheets of paper corresponds to the command value of movement of the pair of registration rollers; and wherein the control portion calculates the command value of movement of the pair of registration rollers corresponding to a basic weight of the sheet of paper using the linear function graph in the storage portion.

2. The image forming apparatus according to claim 1 wherein the upper-limit control value is at least any one of a limited time of movement and an upper limit of movement, the limited time of movement being set in relation to a period of moving time from the time when the pair of registration rollers starts moving to the time when the pair of registration rollers finishes moving, the upper limit of movement being set in relation to the maximum value in a moving permissible range from a position at which the pair of registration rollers starts moving to a position at which the pair of registration rollers finishes moving.

3. The image forming apparatus according to claim 1 wherein the control portion calculates the command value of movement which corresponds to frictional power occurring between a conveying path for allowing the sheet of paper to be carried to the transferring portion and the sheet of paper.

4. The image forming apparatus according to claim 3 wherein when the frictional power occurring between the conveying path and the sheet of paper is increased, the control portion sets the command value of movement so as to be larger.

5. An image forming apparatus comprising:

an image forming portion that forms an image on an image carrier;

a transferring portion that transfers the image formed on the image carrier to a sheet of paper;

a pair of conveying rollers that convey the sheet of paper to the transferring portion;

a detection portion that detects an amount of deviation in the sheet of paper relative to a reference position of an edge of the sheet of paper;

a control portion that calculates a command value of movement of the pair of conveying rollers corresponding to a basic weight of the sheet of paper using a linear function graph in order to correct the amount of deviation in the sheet of paper, wherein the control portion further comprises a storage portion that stores data, the data including a correction coefficient and y-intercept in the linear function graph in which an amount of movement of the pair of conveying rollers corresponding to the basic weights of plural sheets of paper corresponds to the command value of movement of the pair of conveying rollers; and a moving portion that moves the pair of conveying rollers toward a direction which is perpendicular to a sheet-conveying direction of the sheet of paper based on the command value of movement with the sheet of paper being nipped, wherein the control portion controls the moving portion to complete the movement of the pair of conveying rollers below an upper-limit control value set in relation to the command value of movement.

6. The image forming apparatus according to claim 5 wherein the control portion calculates the command value of movement which corresponds to frictional power occurring between a conveying path for allowing the sheet of paper to be carried to the transferring portion and the sheet of paper.

7. The image forming apparatus according to claim 6 wherein when the frictional power occurring between the conveying path and the sheet of paper is increased, the control portion sets the command value of movement so as to be larger.

* * * * *